US008297865B2

(12) United States Patent
McGarry

(10) Patent No.: US 8,297,865 B2
(45) Date of Patent: Oct. 30, 2012

(54) MEDIA TRANSPORT

(75) Inventor: Colman McGarry, Dundee (GB)

(73) Assignee: NCR Corporation, Duluth, GA (US)

( * ) Notice: Subject to any disclaimer, the term of this patent is extended or adjusted under 35 U.S.C. 154(b) by 595 days.

(21) Appl. No.: 12/491,853

(22) Filed: Jun. 25, 2009

(65) Prior Publication Data

US 2010/0327509 A1 Dec. 30, 2010

(51) Int. Cl.
*B41J 13/00* (2006.01)
*B65H 29/00* (2006.01)

(52) U.S. Cl. ..... 400/642; 271/185; 271/187; 271/902; 235/31 T

(58) Field of Classification Search ..... 400/625, 400/628, 636, 642; 271/902; 235/31 R, 235/31 T, 58 CF
See application file for complete search history.

(56) References Cited

U.S. PATENT DOCUMENTS

| | | | | |
|---|---|---|---|---|
| 5,090,680 | A * | 2/1992 | Yashiro | 271/186 |
| 5,374,049 | A * | 12/1994 | Bares et al. | 271/186 |
| 6,000,867 | A * | 12/1999 | Yoshii et al. | 400/188 |
| 7,420,578 | B2 * | 9/2008 | Kohira | 347/197 |
| 7,819,597 | B2 * | 10/2010 | Kohira | 400/120.01 |
| 2006/0055759 | A1 * | 3/2006 | Kohira | 347/104 |

FOREIGN PATENT DOCUMENTS

| | | | |
|---|---|---|---|
| DE | 4417770 | A1 * | 11/1995 |
| JP | 2000063022 | A * | 2/2000 |

* cited by examiner

*Primary Examiner* — Ren Yan
(74) *Attorney, Agent, or Firm* — Michael Chan

(57) ABSTRACT

A media transport comprises: a media entrance for receiving a length of media (such as a receipt); an arcuate media store for storing the length of media in a coiled configuration; a media exit (such as a receipt aperture) through which the length of media can be presented (for example, to a customer); and a drive mechanism. The drive mechanism is operable in a first direction to drive the length of media from the entrance into the arcuate media store. The drive mechanism is also operable in a second direction to drive the length of media from the entrance through the media exit for presentation to a customer.

9 Claims, 3 Drawing Sheets

MEDIA TRANSPORT

FIELD OF INVENTION

The present invention relates to media transport. In particular, though not exclusively, the invention has application to printer transport mechanisms.

BACKGROUND OF INVENTION

Printers are commonly used in self-service terminals (SSTs), such as automated teller machines (ATMs), to provide a customer with a receipt, a statement, or some other customer printed document.

One problem associated with printers in a self-service environment is that a customer may attempt to remove a receipt prior to the receipt being completely printed. With short length receipts this is rare because a trailing edge of the receipt paper has cleared the print head prior to the leading edge of the receipt paper protruding through a receipt paper aperture in the SST fascia. However, where the receipt length exceeds the length of the transport mechanism, customers can pull the receipt prior to completion of printing. This can result in the receipt jamming or the receipt being removed with only part of the receipt data printed thereon.

It is among the objects of an embodiment of the present invention to obviate or mitigate the above disadvantage or other disadvantages associated with prior art media transports.

SUMMARY OF INVENTION

Accordingly, the invention generally provides methods, systems, and apparatus for an improved media transport.

In addition to the Summary of Invention provided above and the subject matter disclosed below in the Detailed Description, the following paragraphs of this section are intended to provide further basis for alternative claim language for possible use during prosecution of this application, if required. If this application is granted, some aspects of the invention may relate to claims added during prosecution of this application, other aspects may relate to claims deleted during prosecution, other aspects may relate to subject matter never claimed. Furthermore, the various aspects detailed hereinafter are independent of each other, except where stated otherwise. Any claim corresponding to one aspect should not be construed as incorporating any element or feature of the other aspects unless explicitly stated in that claim.

According to a first aspect there is provided a media transport comprising a media entrance for receiving a length of media; an arcuate media store for storing the length of media in a coiled configuration; a media exit through which the length of media can be presented; and a drive mechanism operable in a first direction to drive the length of media from the entrance into the arcuate media store, and in a second direction to drive the length of media from the entrance through the media exit for presentation to a user.

The media transport may be a printer transport.

The media entrance may receive a length of paper from a print engine.

The arcuate media store may be a drum-shaped store.

The media transport may include an arcuate guide extending from the media exit to near the media entrance.

The arcuate guide may include a resilient diverter that is biased upwards, so that, during use, the diverter is urged downwards by media as it passes over the diverter to the drive mechanism, but deflects the media into the arcuate guide when the drive mechanism is reversed.

The arcuate guide may include an opening portion for facilitating insertion of the length of media from the media entrance.

The arcuate guide may include a funnel opening portion for facilitating insertion of the length of media from the media entrance.

The arcuate guide may define a tapered channel for guiding the length of media to the media exit. The tapered channel may be wider at the entrance than at the media exit.

The drive mechanism may comprise a roller co-operating with a skid plate, a pair of rollers, a pair of endless belts, a belt co-operating with a roller, a gear train, or the like.

The roller may comprise a wheel, a drum, a polygon, or the like. The roller may have a circumference that is discontinuous (stepped) or continuous.

According to a second aspect there is provided a method of presenting media to a user, the method comprising: receiving a length of media from an engine; driving the received length of media into a store to form an arcuate length of stored media; and driving the arcuate length of stored media out from the media store and into an arcuate guide to present the length of media to a user once the length of media has been discharged from the engine.

According to a third aspect there is provided a printer transport comprising a media entrance for receiving a length of media; an arcuate media store for storing the length of media in a coiled configuration; a media exit through which the length of media can be presented; and a drive mechanism operable in a first direction to drive the length of media from the entrance into the arcuate media store, and in a second direction to drive the length of media from the entrance through the media exit for presentation to a user.

According to a fourth aspect there is provided a printer including the transport of the third or first aspects.

According to a fifth aspect there is provided a self-service terminal including the transport of the third or first aspects.

The self-service terminal may be an automated teller machine (ATM), an information kiosk, a financial services center, a bill payment kiosk, a lottery kiosk, a postal services machine, a check-in and/or check-out terminal such as those used in the retail, hotel, car rental, gaming, healthcare, and airline industries, or the like.

According to a sixth aspect there is provided a method of presenting media to a user, the method comprising: receiving a length of media from an engine; driving the received length of media into a store to form an arcuate length of stored media; discharging the length of media from the engine; and driving the arcuate length of stored media out from the media store and into an arcuate guide to present the length of media to a user.

According to a seventh aspect there is provided a method of retrofitting a printer, the method comprising providing the printer with a media transport according to the first or third aspects of the invention.

These and other aspects will be apparent from the following specific description, given by way of example, with reference to the accompanying drawings.

DETAILED DESCRIPTION

Figure 1:
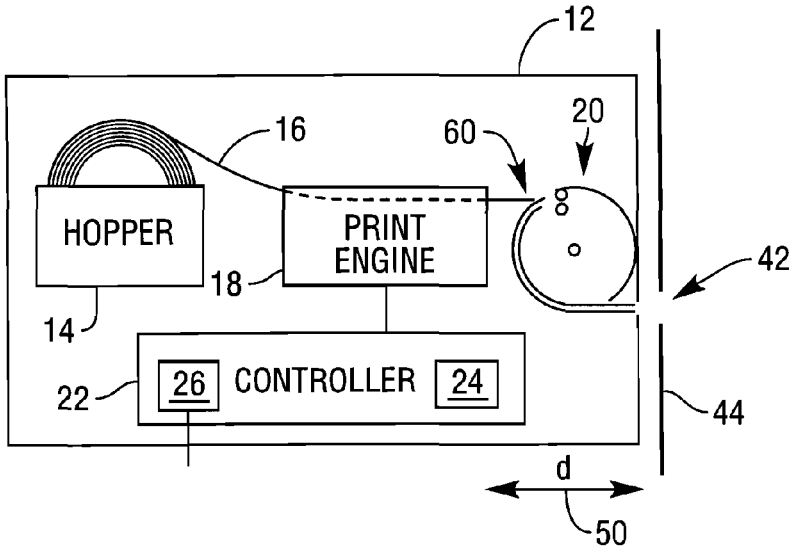
FIG. 1 is a simplified schematic diagram of a printer according to one embodiment of the present invention.

Reference is first made to FIG. 1, which is a simplified schematic diagram of a printer 10 according to one embodiment of the present invention. The printer 10 comprises a paper hopper 12 storing a roll 14 of paper 16; a print engine 18 supplied with paper 16 from the roll 14; a paper transport 20; and a printer controller 22.

The printer controller 22 includes a processor 24 and a communications facility 26 (such as a USB port or an RS 232 port) for communicating with an ATM controller (not shown). The printer controller 22 receives commands and print data and from the ATM controller (not shown) and sends messages to the ATM controller (not shown) to indicate: that a print task was completed successfully, the status of components within the printer 10 (for example, if the paper roll 14 is nearly finished), and the like.

Figure 2:
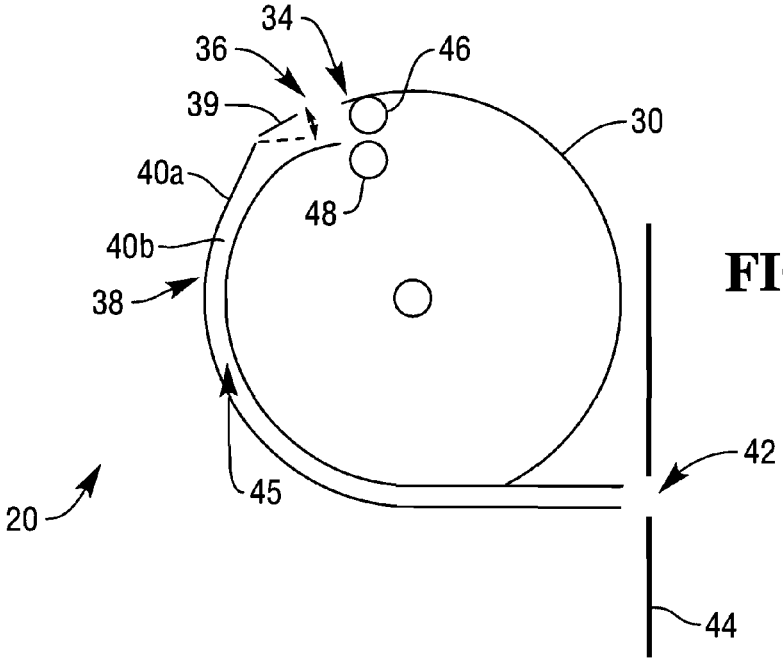
FIG. 2 is a simplified schematic diagram of the printer of FIG. 1, showing a part thereof (the paper transport) in more detail.

Reference is also made to FIG. 2, which is a simplified schematic diagram showing the paper transport 20 in more detail. The paper transport 20 comprises: an arcuate store 30 (in the form of a generally drum-shaped receptacle); a drive mechanism 34 at the entrance 36 of the arcuate store 30; and an arcuate guide 38. The arcuate guide 38 comprises (i) a diverter portion 39 near the entrance 36 and (ii) sidewalls 40*a,b* leading from the vicinity of the entrance 36 to a receipt aperture 42 defined by a fascia 44 in a self-service terminal (not shown). The sidewalls 40 define a channel 45 that tapers from the vicinity of the entrance 36 to the receipt aperture 42. One sidewall 40*b* is provided by an external wall of the arcuate store 30.

The drive mechanism 34 comprises a retractable upper roller 46 and a fixed lower roller 48, spaced apart to co-operate in driving a length of receipt paper 16 into and out of the arcuate store 30. The upper roller 46 is driven by the printer controller 22, but the lower roller 48 is free to rotate as receipt paper 16 passes over it.

The distance between the front end of the print engine 18 and the receipt aperture 42 is "d", illustrated by double headed arrow 50. In this embodiment, "d" is approximately 8 cm. A typical ATM receipt is approximately 11 cm long, but printer 10 is capable of printing and delivering receipts substantially longer than 11 cm (for example, 25 cm).

Figure 3:
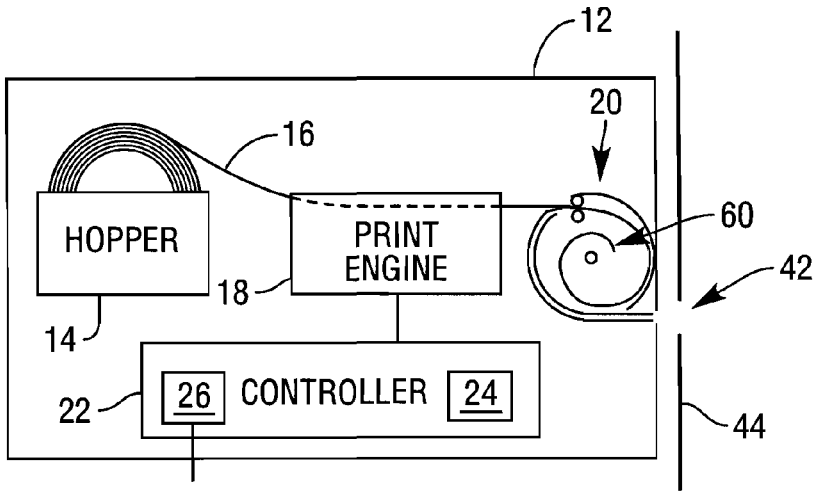
FIG. 3 is a simplified schematic diagram of the printer of FIG. 1, showing receipt paper entering a part (the arcuate store) of the paper transport.
Figure 4:
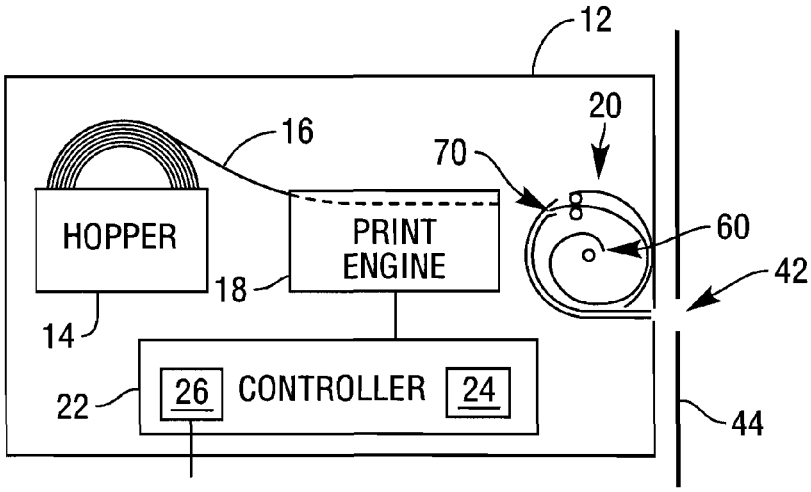
FIG. 4 is a simplified schematic diagram of the printer of FIG. 1, showing receipt paper exiting the arcuate store.

The operation of the printer 10 will now be described with reference to FIGS. 3 to 5, which are schematic diagrams illustrating the printer 10 with a printed receipt at different locations within the printer 10, and also with reference to FIG. 6, which is a flowchart 100 illustrating the operation of the printer 10.

Initially, the printer controller 22 receives print data from the ATM controller (not shown) (step 110), which it uses to control the print engine 18 to advance paper (step 112) through a print head (not shown) in the print engine 18, while printing the received data onto the advancing paper 16 (step 114).

The printer controller 22 starts the paper transport 20 (step 116) by driving the upper roller 46 anti-clockwise. As the printed paper 16 continues to advance, a leading edge 60 of the printed paper 16 pushes down the diverter portion 39 and is then nipped between the upper and lower rollers 46,48 and driven into the arcuate store 30 at the same speed as the paper is advanced. As the printed paper 16 enters the arcuate store 30, the printed paper 16 bends inwards, as illustrated in FIG. 3, due to the shape of the arcuate store 30 and the influence of gravity.

When the print engine 18 has completely printed the paper 16, then the print engine 18 cuts the paper (step 118) to produce a printed receipt.

The printer controller 22 continues to drive the upper roller 46 anti-clockwise (step 120) until a predetermined distance is reached (step 122), which is less than the distance between the cutting blade (not shown) in the print engine 18 and the drive mechanism 34 of the paper transport 20, but greater than the distance between the cutting blade (not shown) and the paper transport entrance 36. This is to ensure that when the upper roller 46 stops driving, a trailing edge 70 of the printed paper 16 protrudes from the drive mechanism 34 but is located within the paper transport 20. When this occurs, the bulk of the printed paper 16 is coiled (or spiraled) within the arcuate store 30, as illustrated in FIG. 4.

The printer controller 22 then reverses the upper roller 46 (step 124) so that the upper and lower rollers 46,48 co-operate to drive the printed paper 16 (the receipt) out of the arcuate store 30, with the trailing edge 70 first (that is, the trailing edge 70 is now leading, and the leading edge 60 is now trailing).

Figure 5:
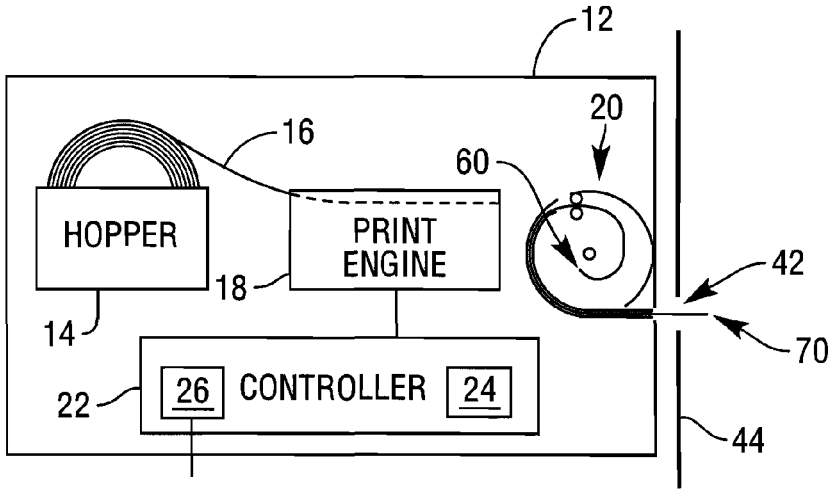
FIG. 5 is a simplified schematic diagram of the printer of FIG. 1, showing receipt paper exiting the paper transport and being presented to a customer.
Figure 6:
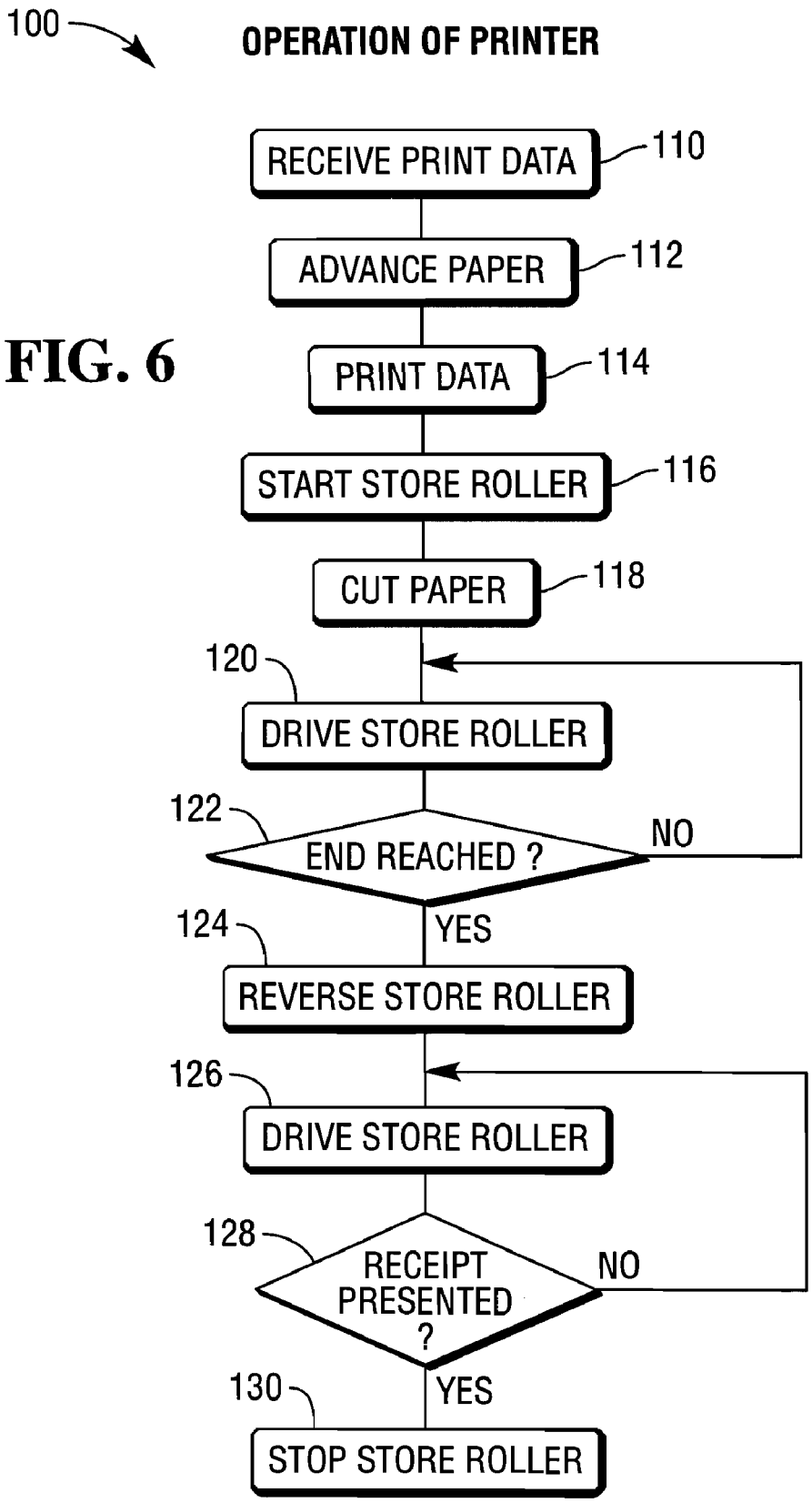
FIG. 6 is a flowchart illustrating the steps involved in presenting the receipt paper to the customer.

As the upper roller 46 rotates clockwise (step 126) the trailing edge 70 (now leading) is driven downwards by the diverter portion 39 and is directed by the sidewalls 40 from the vicinity of the entrance 36 to the receipt aperture 42 defined by the fascia 44, as illustrated by FIG. 5. Thus, the arcuate guide 38 guides the trailing edge 70 towards the receipt aperture 42.

The upper roller 46 is rotated until the receipt 16 is presented to a customer by protruding through the receipt aperture 42 by a predetermined distance (for example, the upper roller 46 may be driven until the trailing edge 70 protrudes by approximately 2 cm to allow the customer to grasp the receipt 16 with his/her finger and thumb) (step 128).

Once the receipt 16 has been presented to the customer then the controller 22 stops the upper roller 46 (step 130) to allow the customer to remove the receipt when he/she is ready to take it.

The action of the customer pulling the receipt uncoils the receipt from the arcuate store 30 and causes the receipt to slide through the arcuate guide 38.

Figure 7:
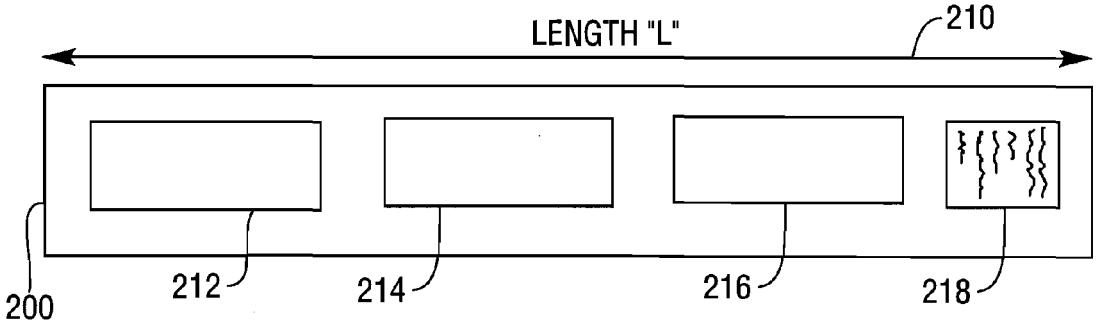
FIG. 7 is a pictorial diagram of a receipt printed by the printer of FIG. 1.

By virtue of this embodiment of the present invention, a comparatively long receipt 200, such as that illustrated in FIG. 7, which has a length "L" of 25 cm (illustrated by arrow 210) can be printed and presented to a customer in a controlled manner. The long receipt 200 includes three images of checks 212,214,216 deposited at the ATM in a single transaction, in addition to transaction details 218. Because the receipt 200 is coiled within the arcuate store 30, it is possible to print variable length receipts, including comparatively long receipts, without risking jamming the printer 10 or a customer removing the receipt 16,200 before it has been printed.

Various modifications may be made to the above described embodiment within the scope of the invention. For example, in other embodiments, the drive mechanism may comprise a roller and a skid plate; endless belts and a skid plate; or any other convenient drive mechanism.

In other embodiments the arcuate guide 38 may not be tapered.

In other embodiments, the arcuate store 30 may be rotatable to facilitate the trailing edge 70 entering the arcuate guide 38.

In other embodiments, the paper transport 20 may be used for transporting other types of media in a media handler other than a printer.

In other embodiments, the paper transport 20 may be retrofitted to a conventional printer.

In other embodiments, an SST other than an ATM may be used to house the printer 10, for example, an information kiosk.

The steps of the methods described herein may be carried out in any suitable order, or simultaneously where appropriate. The methods described herein may be performed by software in machine readable form on a tangible storage medium or as a propagating signal.

The terms "comprising", "including", "incorporating", and "having" are used herein to recite an open-ended list of one or more elements or steps, not a closed list. When such terms are used, those elements or steps recited in the list are not exclusive of other elements or steps that may be added to the list.

What is claimed is:

1. A media transport comprising:

a first sidewall member including an inner arcuate surface;

a second sidewall member including (i) an outer arcuate surface, and (ii) an inner arcuate surface which together with the inner arcuate surface of the first sidewall member defines a substantially drum-shaped storage chamber into which a length of media can be stored in a coiled configuration;

a third sidewall member including an inner arcuate surface which faces the outer arcuate surface of the second sidewall member to form an arcuate guide channel therebetween;

a media storage entrance/exit for receiving a length of media into and out of the substantially drum-shaped storage chamber;

a media channel entrance located at one end of the arcuate guide channel and in the vicinity of the media storage entrance/exit and for receiving a length of media which is exiting the substantially drum-shaped storage chamber;

a media channel exit located at an opposite end of the arcuate guide channel and through which a length of media can be presented to a user when the length of media is guided from the media channel entrance through the arcuate guide channel to the media channel exit; and a drive mechanism operable in a first direction to drive a length of media from the media storage entrance/exit into the substantially drum-shaped storage chamber, and in a second direction which is opposite the first direction to drive the length of media from the media storage entrance/exit out of the substantially drum-shaped storage chamber to the media channel entrance through the arcuate guide channel to the media channel exit and thereby to present the length of media through the media channel exit to a user.

2. A media transport according to claim 1, wherein the third sidewall member is separate and spaced apart from each of the first and second sidewall members.

3. A media transport according to claim 2, wherein the first and second sidewall members are separate and spaced apart from each other.

4. A media transport according to claim 1, wherein the media storage entrance/exit and the media channel entrance are located on one side of a center axis of the substantially drum-shaped storage chamber, and the media channel exit is located on an opposite side of the center axis of the substantially drum-shaped storage chamber.

5. A media transport according to claim 4, wherein the arcuate guide channel is substantially C-shaped such that (i) the media channel entrance is located at one end of the C-shape, (ii) the media channel exit is located at the other end of the C-shape, and (iii) the center axis is disposed between the media channel entrance and the media channel exit.

6. A media transport according to claim 1, wherein the media transport conveys paper.

7. A media transport according to claim 1, further comprising a diverter for (i) directing a length of media to the media storage entrance/exit into the substantially drum-shaped storage chamber, and (ii) directing a length of media from the media storage entrance/exit out of the substantially drum-shaped storage chamber to the media channel entrance into the arcuate guide channel.

8. A media transport according to claim 1, wherein the arcuate guide channel is tapered for guiding a length of media from the media channel entrance to the media channel exit.

9. A media transport according to claim 1, wherein the drive mechanism comprises a pair of rollers.

* * * * *